US007837056B2

(12) United States Patent
Stribling et al.

(10) Patent No.: US 7,837,056 B2
(45) Date of Patent: Nov. 23, 2010

(54) SNAP-FIT VALVE

(75) Inventors: Robert Stribling, Monroe, GA (US); Samuel Clifford Crosby, Lilburn, GA (US)

(73) Assignee: The Last Straw LLC, Monroe, GA (US)

( * ) Notice: Subject to any disclaimer, the term of this patent is extended or adjusted under 35 U.S.C. 154(b) by 401 days.

(21) Appl. No.: 11/164,700

(22) Filed: Dec. 1, 2005

(65) Prior Publication Data

US 2006/0201955 A1 Sep. 14, 2006

Related U.S. Application Data

(63) Continuation-in-part of application No. 10/905,550, filed on Jan. 10, 2005.

(60) Provisional application No. 60/534,982, filed on Jan. 9, 2004.

(51) Int. Cl.
*B65D 25/40* (2006.01)
*A47G 19/22* (2006.01)

(52) U.S. Cl. ..... 220/705; 220/229; 220/714

(58) Field of Classification Search ..... 220/705, 220/203.11, 203.17, 229, 709, 714, 719
See application file for complete search history.

(56) References Cited

U.S. PATENT DOCUMENTS

| | | | | |
|---|---|---|---|---|
| 5,054,631 | A | 10/1991 | Robbins, III | |
| 5,113,900 | A | 5/1992 | Gilbert | |
| 5,184,774 | A | 2/1993 | Lipson | |
| 5,730,336 | A | 3/1998 | Lerner | |
| 5,868,701 | A * | 2/1999 | Powers, Jr. | 604/500 |
| 5,911,406 | A * | 6/1999 | Winefordner et al. | 251/339 |
| 6,039,305 | A | 3/2000 | Hoskins et al. | |
| 6,135,311 | A | 10/2000 | Panec | |
| 6,273,128 | B1 * | 8/2001 | Paczonay | 137/512.3 |
| 2002/0115961 | A1 | 8/2002 | Writt, Sr. | |
| 2003/0029503 | A1 * | 2/2003 | Williamson et al. | 137/510 |
| 2003/0037820 | A1 * | 2/2003 | Williamson et al. | 137/510 |
| 2003/0071136 | A1 * | 4/2003 | Ference | 239/33 |
| 2003/0173536 | A1 * | 9/2003 | Christensen et al. | 251/342 |
| 2003/0222238 | A1 | 12/2003 | Getzewich et al. | |
| 2004/0217187 | A1 * | 11/2004 | Renz et al. | 239/33 |
| 2004/0232375 | A1 * | 11/2004 | Steckel | 251/342 |
| 2005/0062009 | A1 * | 3/2005 | Hoskins | 251/342 |
| 2005/0145636 | A1 * | 7/2005 | Albright et al. | 220/714 |
| 2005/0242130 | A1 * | 11/2005 | Yang | 222/490 |

FOREIGN PATENT DOCUMENTS

| | | |
|---|---|---|
| EP | 0 266 067 | 5/1988 |
| EP | 0266067 | 5/1988 |
| GB | 705354 | 3/1954 |
| WO | WO 95/13786 | 5/1995 |
| WO | 2005070253 | 4/2005 |
| WO | WO 2005/070253 A1 | 8/2005 |

* cited by examiner

*Primary Examiner*—Anthony Stashick
*Assistant Examiner*—Niki M Eloshway
(74) *Attorney, Agent, or Firm*—Cantor Colburn LLP

(57) ABSTRACT

A flexible check valve is introduced within a fluid path for leakage protection. The flexible check valve is preferably a crossbill used in conjunction with a drinking straw to prevent undesired liquid leakage from a container such as a drink box. A transition section is used to mate the dissimilar materials of the straw and flexible check valve. The transition section retains an internal bayonet section of the flexible check valve within a snap-fit ring.

23 Claims, 11 Drawing Sheets

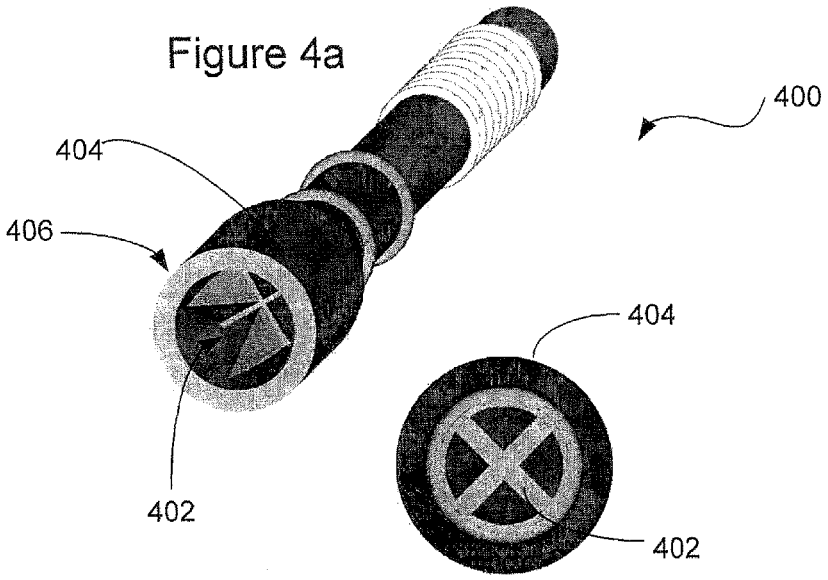
Figure 4a
Figure 4b
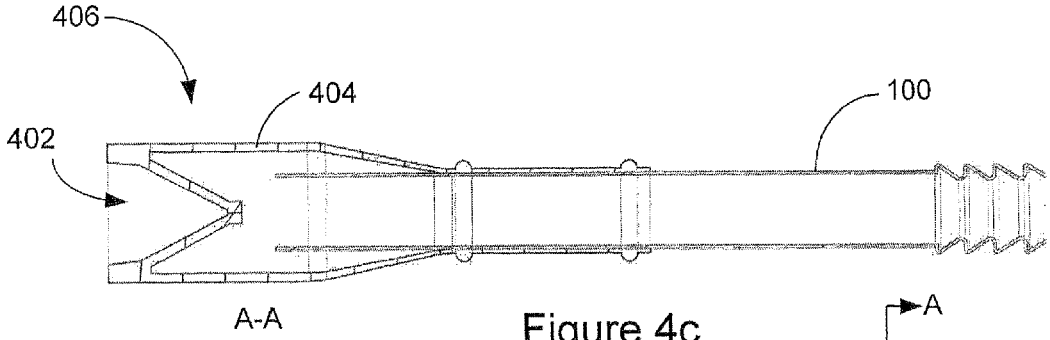
Figure 4c
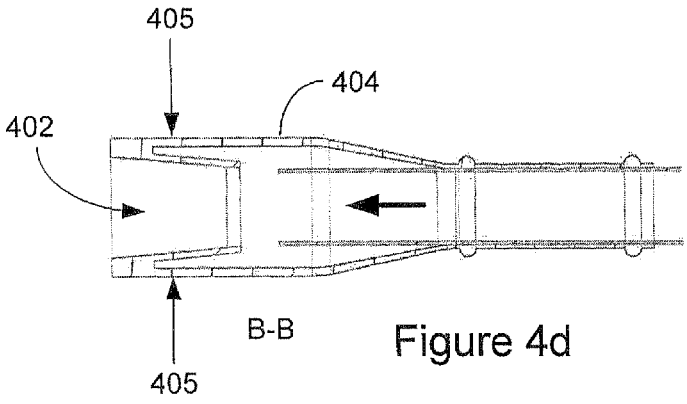
Figure 4d
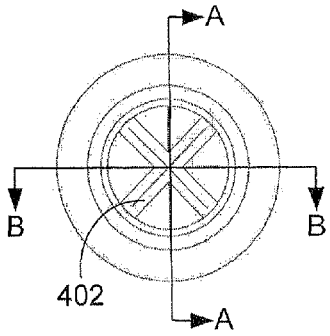
Figure 4e

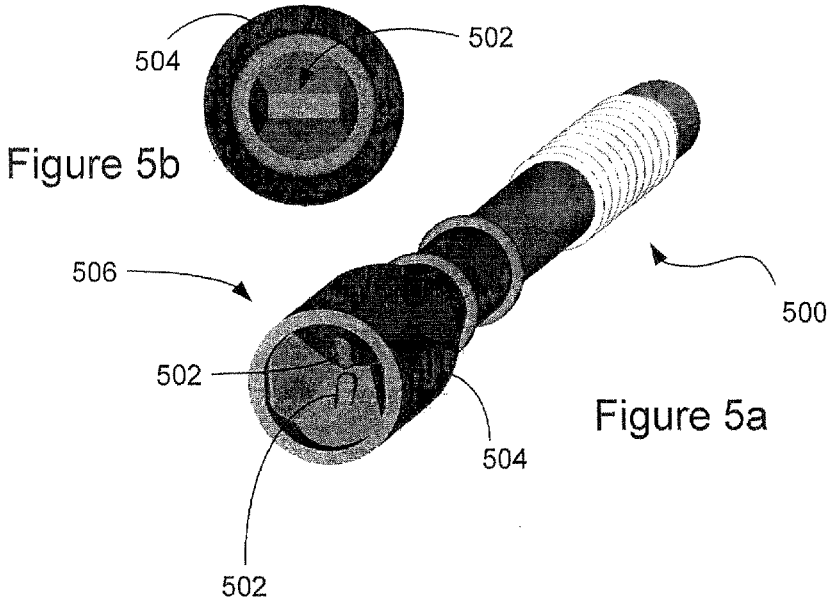
Figure 5b
Figure 5a
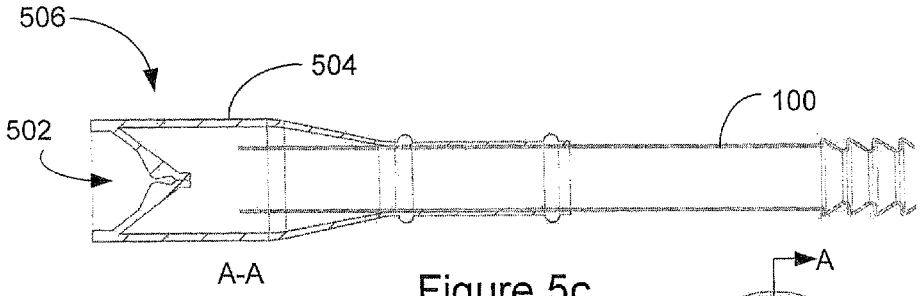
Figure 5c
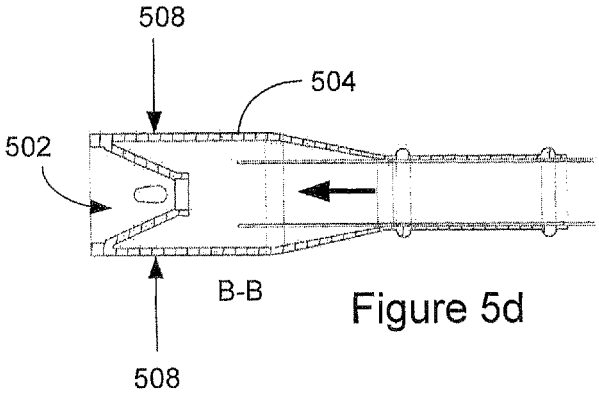
Figure 5d
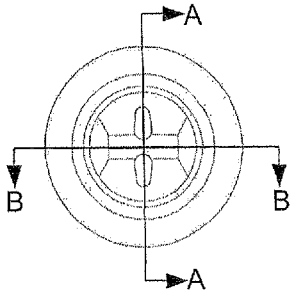
Figure 5e

SNAP-FIT VALVE

RELATED APPLICATIONS

The present application is a continuation-in-part of patent application Ser. No. 10/905,550 filed Jan. 10, 2005, and claims the benefit of provisional patent application 60/534,982, filed Jan. 9, 2004.

FIELD OF INVENTION

The present invention is related to fluid flow control and more specifically leakage protection in a straw application.

DISCUSSION OF PRIOR ART

Juice boxes and pouches are well known sealed drinking containers. Typically, these containers have attached a plastic sealed straw, which is removed and used to puncture and drain the liquid within. These containers are predominantly used by children, who through various means enable liquid to escape the straw during non-drinking situations. One problem associated with the straws is the forced evacuation of liquid through squeezing of the container or by vacuum related capillary action. Tipping of the container may also cause liquid spills. The present invention reduces or eliminates the unwanted draining of the container.

One problem associated with adding a valve to a drinking straw is compliance with US Safety requirements, specifically choking, especially with small children. The valve cannot be pulled or chewed off easily. However, many problems are encountered when trying to connect a soft material (e.g. silicone valve) to a firmer material (e.g. polypropylene straw). An apparatus and method is needed that is both a safe and effective way to attach dissimilar materials.

Whatever the precise merits, features, and advantages of the prior art, it does not achieve or fulfill the purposes of the present invention.

SUMMARY OF THE INVENTION

The present invention uses a valve within a fluid path for leakage protection. The valve is preferably a flexible check valve such as crossbill. The flexible check valve is preferably used within a tubular section having a fluid path and is attached to the exit end of a straw. Preferably, the flexible check valve is a crossbill valve that is attached using an adapter and secured with a snap-fit arrangement. The flexible members of the valve may comprise several embodiments.

The valve comprises two or more flexible members that restrict the flow of liquid from a container during non-drinking situations. The flexible members of the valve limit pressurized flow and substantially prevent liquid from exiting while remaining normally closed. To open a valve section, external compressive force is applied (e.g., by a user's fingers or lips) which separates the flexible members allowing liquid to flow through. When external compressive force is no longer applied to the valve section, the valve returns to its normally closed position and fluid is prevented from exiting. Pressurized forces, such as liquid trying to escape through the straw when a user squeezes the drinking container, only serve to press the flexible members together with greater force.

BRIEF DESCRIPTION OF THE DRAWINGS

FIG. 4*a* illustrates a perspective view of a crossbill valve.

FIG. 4*b* illustrates an internal rear view of the crossbill valve of FIG. 4.

FIG. 4*c* illustrates section A-A of FIG. 4*e*, which is a cutaway or sectional side view of the crossbill valve of FIG. 4*a*.

FIG. 4*d* illustrates section B-B of FIG. 4*e*, which is a cutaway or sectional top (or bottom) view of FIG. 4*a*.

FIG. 4*e* illustrates an end view of the crossbill valve of FIG. 4*a*.

FIG. 5*a* illustrates a perspective view of a single duckbill valve.

FIG. 5*b* illustrates an internal rear view of the single duckbill valve of FIG. 5*a*.

FIG. 5*c* illustrates section A-A of FIG. 5*e*, which is a cutaway or sectional side view of the crossbill valve of FIG. 5*a*.

FIG. 5*d* illustrates section B-B of FIG. 5*e*, which is a cutaway or sectional top (or bottom) view of FIG. 5*a*.

FIG. 5*e* illustrates an end view of the single duckbill valve of FIG. 5*a*.

FIG. 11 also represents the external view of FIG. 7.

DESCRIPTION OF THE PREFERRED EMBODIMENTS

Figure 1:
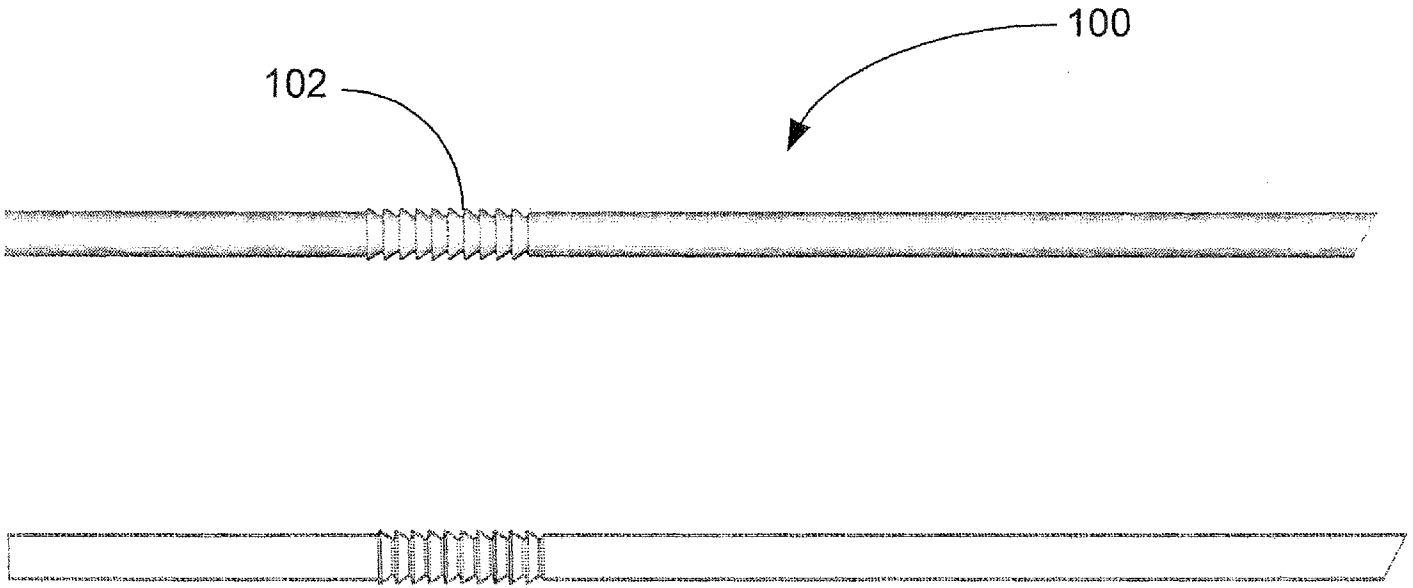
FIG. 1 illustrates an existing straw for a drink product.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention. In the description below it should be noted that the term "fluid" should include any type of liquid, gas, powder, particulate, gel, or colloid. Throughout the disclosure (including claims), the phrase "flexible check valve" is interchangeably used to describe both the valve and the valve and enclosure tube ensemble as they are integrally formed. Also, the attachment methods shown in the preferred embodiment can be used with other flexible check valves without departing from the scope of the invention.

FIG. 1 illustrates an existing drinking straw 100 for a drink container or product, such as a drink box or drink pouch. Straw 100 includes flexible section 102 for bending the straw end to ease drinking. The straw typically is 6.02 inches long, 0.180 inches wide, has a wall thickness of 0.007 inches, and has an outer diameter of 0.0168 inches. Also, the straw may have a tensile strength of 5700 psi, a cross sectional area of 0.0038 square inches, and a tensile limit of 21.7 pounds.

Figure 2B:
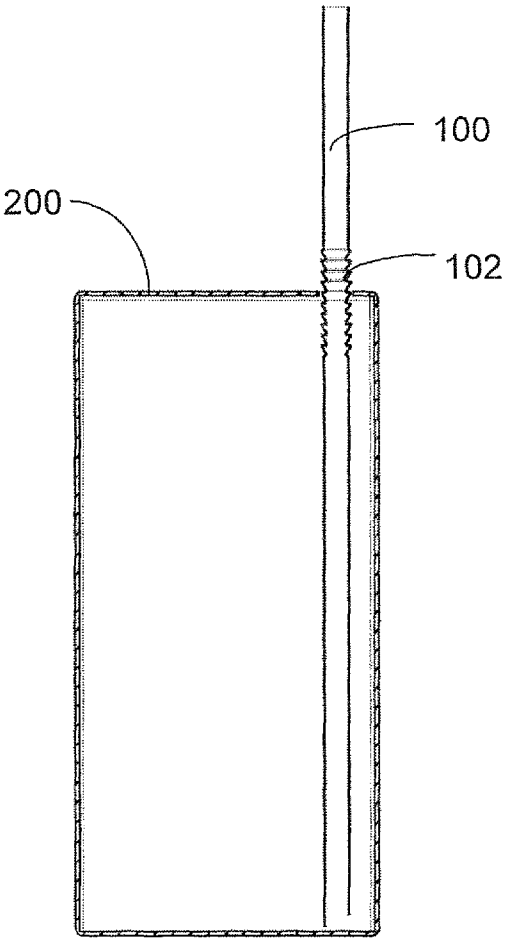
FIG. 2*b* illustrates the use of the straw from FIG. 1 when inserted into a drink product.
Figure 2A:
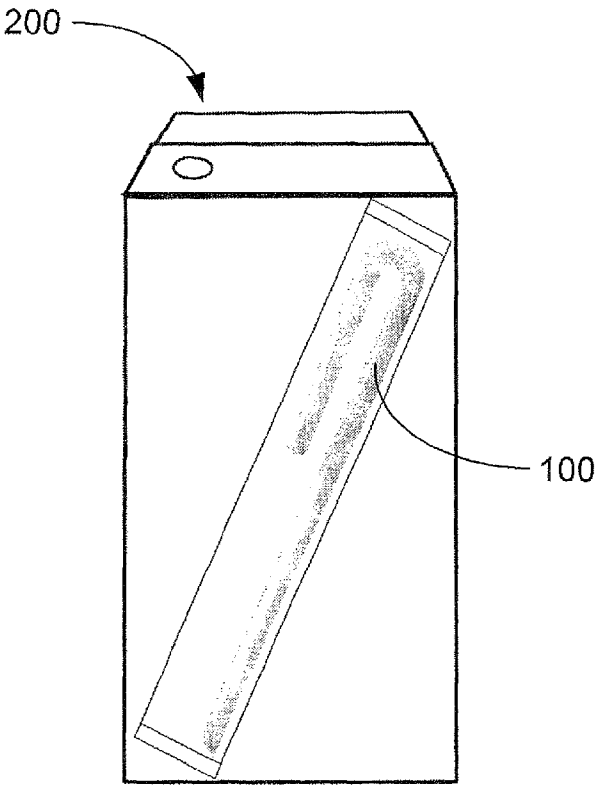
FIG. 2*a* illustrates the packaging of the straw from FIG. 1 before use (i.e. attached to outside of product).

FIG. 2*a* illustrates an example of packaging of existing drinking straw 100 with juice box 200. The box may have, for example, a length of 4.20 inches. To accommodate the length of the juice box, straw 100 is bent during packaging. FIG. 2*b* illustrates the use of straw 100 in juice box 200. Typically, straw 100 is punched through box 200 to access the juice (or drinking fluid) within.

Figure 3:
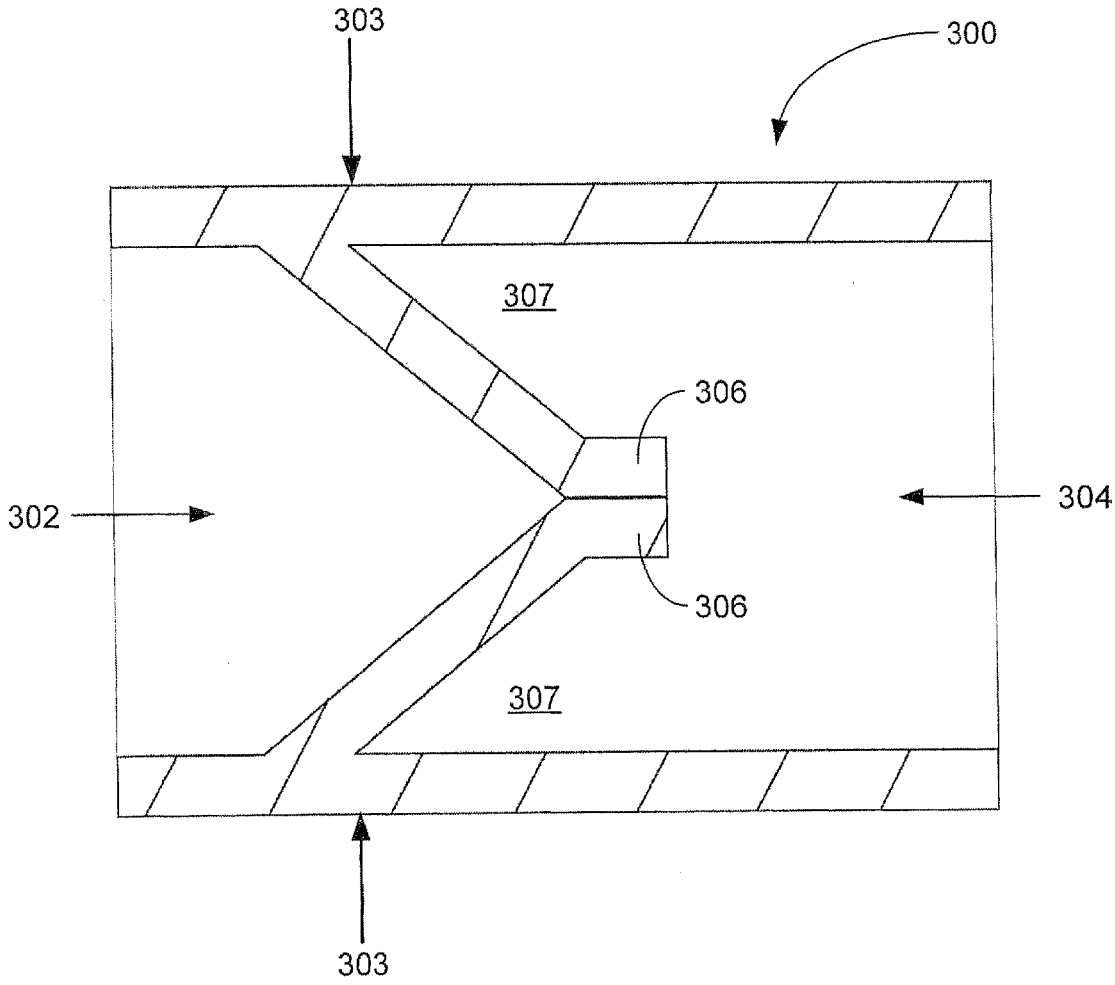
FIG. 3 illustrates a cutaway or section of a duckbill check valve used in the present invention.

Illustrated in FIG. 3 is an example of a cutaway or section of a flexible "duckbill" check valve 300. Duckbill valve 300 is a "one-way" valve typically of one-piece construction. Valve 300 comprises two flexible members 306 that resemble a "duckbill"; however, any sort, shape, number, material or variation of flaps or lips may be used. Flexible members 306 are used to form a check or mouth portion 302 and flow portion 304. Flexible members 306 are preferably made of elastomeric material, and are used to prevent reverse flow or leakage. It should be noted, however, that the valve body may be made of any material, and that flexible members may be made of any material that allows for movement of the flexible members, preferably by way of finger or lip or mouth pressure.

Valve 300 may be used for leakage prevention for a tubular section having a fluid path. The valve is used to prevent fluid that is in a pressurized state (such as from squeezing, capillary action, or tipping) from exiting a container. In order to reduce or eliminate the unwanted draining of the container, one present invention embodiment utilizes a duckbill valve as shown in the example in FIG. 3 in conjunction with a straw. Since a duckbill valve is normally closed, it is advantageous when used with liquids such as juice or drink. Flexible check valves (e.g. duckbill) may be opened by minimal action by a consumer (e.g., circumferentially compressing the valve with mouth, fingers, teeth, or lips), and return to a closed position when the action ceases. In other words, the user pinches the tubular surface in close proximity to the internally encapsulated valve. Referring back to FIG. 3, when compressive force 303 is applied to the valve, flexible members 306 separate, thus allowing flow from 304 to pass through the opening. However, when the compressive force is not applied (non-drinking situation) and a user applies a pressurized force (e.g. squeezing the juice container) the fluid flows into the cavities 307 applying pressure to flexible members 306, thereby strengthening the seal or check 302 of the valve and wholly or substantially preventing the exit of the fluid there through.

FIGS. 4*a* through 4*e* and 5*a* through 5*e* illustrate embodiments of the present invention of flexible check valves that may be attached to an existing straw; however, the straw may also be formed as a single structure with the valve as an internal part of the straw structure. The figures illustrate the valve in further detail. However, in general, the exiting end (distal) of the straw comprises at least a mouth portion, flexible check valve, a side or pressure point, and a connection section. The flexible check valve is preferably located on the inside of the mouth portion and comprises two or more flexible members that resemble a "duck bill" valve; however, any sort, shape, number, material or variation of flaps or lips may be used. For example, FIGS. 4*a* and 4*b* illustrate a perspective and internal rear view of a crossbill valve 400 that may be used with existing drinking straw 100. FIG. 4*c*-4*e* illustrates a cutaway or sectional side view, cutaway top (or bottom) view, and end view of crossbill valve tubular structure 400. FIG. 4*c* illustrates section A-A of FIG. 4*e*. FIG. 4*d* illustrates section B-B of FIG. 4*d*. Section B-B illustrates a top or bottom sectional view of valve 400. Duckbill valve 400 comprises mouth portion 406 with cross angled members 402 and circumferential side 404. In general, valve 400 is larger in diameter than straw 100; however, equal diameters would not depart from the scope of the present invention. As shown in the figures, valve 400 remains normally closed.

In order to use the straw, a user applies a compressive force 405 to side 404, such as by using their mouth (or lips or fingers or teeth) over the mouth portion 406 to distort the connection of cross angled members 402 of valve 400. Cross angled members 402 then open to allow liquid to come through the space between them. When force or pressure are no longer applied to side 404, valve 400 returns to its normally closed position and liquid is wholly or substantially prevented from exiting the container. One benefit to selecting the preferred crossbill embodiment (FIGS. 4*a*-4*e*), is that during use or during manufacturing no orientation step is required when connecting the valve to the straw. That is, the user may place pressure on almost any area of circumferential side 404 without concern for the orientation of the internal check valve (omni directional).

Another embodiment of the flexible check valve of the present invention is shown in FIGS. 5*a*-5*e*. FIGS. 5*a* and 5*b* illustrate a perspective and internal rear view of single duckbill valve 500 used with existing drinking straw 100. FIGS. 5*c*-5*e* illustrate a cutaway or sectional side view, cutaway top view, and end view of single duckbill valve 500. FIG. 5*c* illustrates section A-A of FIG. 5*e*. FIG. 5*d* illustrates section B-B of FIG. 5*d*. Section B-B illustrates a top or bottom sectional view of valve 500. Duckbill valve 500 comprises a mouth portion 506 with lobe members 502 and circumferential side 504. Again, valve 500 is larger in diameter than straw 100; however, equal diameters would not depart from the scope of the present invention. Two lobe members 502 are formed in mouth portion 506. As shown in the figures, valve 500 remains normally closed. In order to use the straw, a user applies force to side 504, such as by using their mouth (or lips or fingers or teeth) over the mouth portion 506 compressing lobe members 502 of valve 500 and forcing valve to open. However, in this case, the orientation in which valve is applied to the straw must be considered in order to optimize performance. Pressure should be applied to the areas on circumferential side 504 in line with lobes 502, as represented by 508 and 510, to optimally open the valve. When force or pressure is properly applied, lobes 502 come together opening the valve to allow liquid to come through the space between them. When force is no longer applied to either side 504 at 508 and 510, valve 500 returns to its normally closed position and liquid is prevented from exiting the container. Therefore, during manufacturing, the attachment should consider the position of lobes 502 when attaching the valve to the straw.

In FIGS. 4*a*, 4*b*, 4*c*, 4*d*, 4*e*, and 5*a*, 5*b*, 5*c*, 5*d*, and 5*e*, the flexible check valve constructions are shown attached to existing straw 100. In general, the valves (for example, as described in FIGS. 4*a*, 4*b*, 5*a*, and 5*b*) may be attached to existing straws using any known method such as over molding, mechanical, shrink tube (heat shrink), friction fit, or adhesives.

Figure 6:
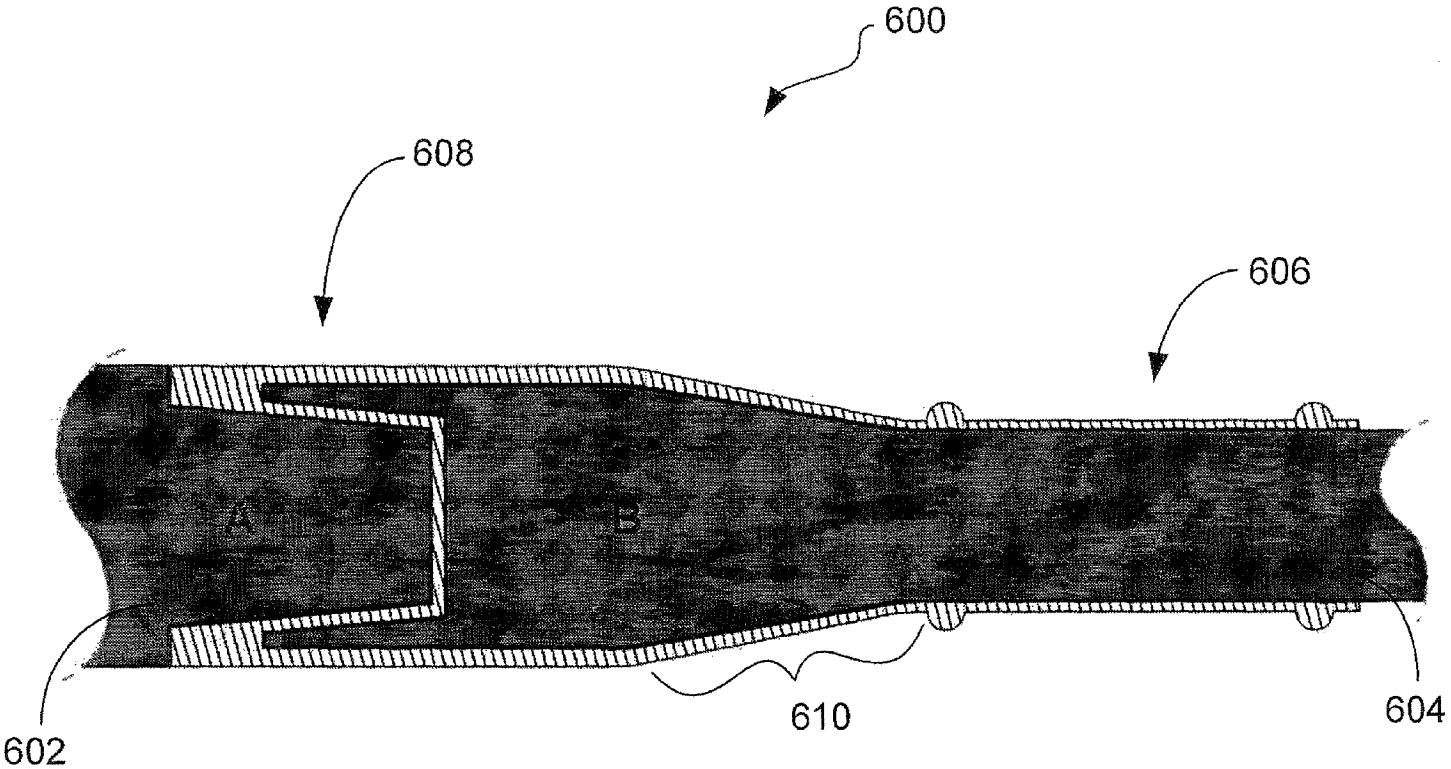
FIG. 6 illustrates the use of a core for manufacturing the duckbill valve.

FIG. 6 illustrates a cutaway or section of the use of a core for manufacturing the above described flexible check valves. Mold core A 602 and mold core B 604 are used to form duckbill valve 600 for a straw. As shown, the valve is compression set molded to create attachment area 606 for attachment to an existing straw and mouth portion 608 comprising a duckbill valve. However, some problems may occur with the method of forming and attaching the described duckbill valve. As previously mentioned, the duckbill valve member is generally larger in diameter than an existing straw. Therefore, when mold core B 604 is used to form valve 600, severe undercut 610 is formed. Undercut 610 may cause problems when retracting the core from the molded valve. For example, if the molded valve is not created from elastomeric material, the valve may have shape retention problems. The size of the valve (in comparison with the straw) can also create dimensional issues when attaching and forming the valve to the straw. In addition, the difference in valve and straw materials can create problems. Existing straws are formed of a plastic such as polypropylene. In a preferred embodiment, the duckbill valve is formed from elastomeric material(s), such as silicone. The material differences create problems with maintaining the attachment of the valve to the straw. Some attachment methods may cause problems with safety issues for children (e.g., choking). The present invention solves the connection process using a novel and safe snap-fit arrangement.

Figure 7:
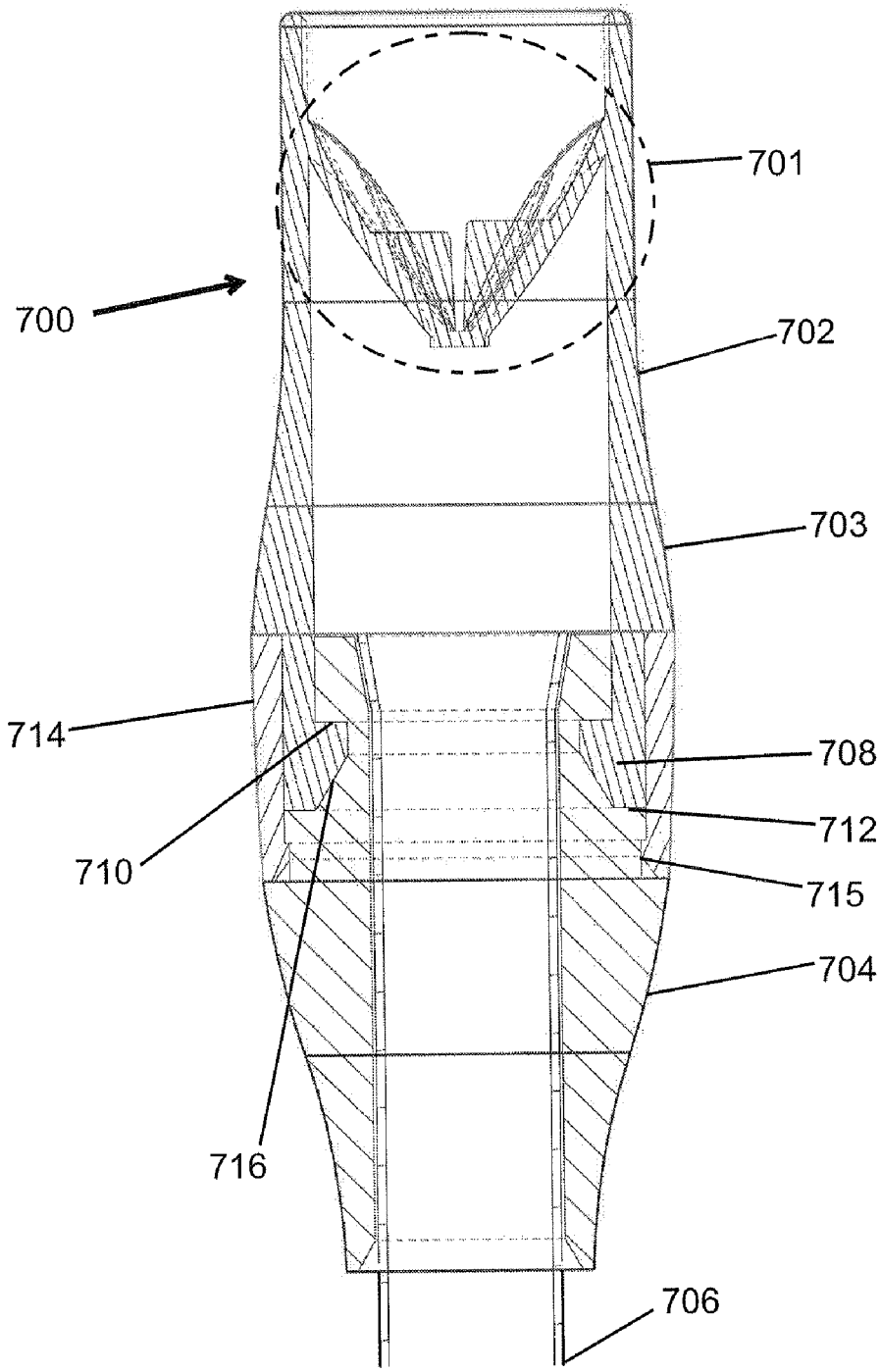
FIG. 7 illustrates a cross-sectional view of an assembled preferred embodiment flexible check valve, associated adapter, snap-fit ring, and fluid tube (e.g. straw).

FIG. 7 illustrates a cross-sectional view of a preferred embodiment flexible check valve 700 attached to a fluid conduit 706. The flexible check valve is constructed of a check valve enclosure tube 702 and integrated flexible check valve 701. An adapter 704 provides the connection between the flexible check valve and fluid tube (e.g. straw) 706. Snap-fit ring 714 retains the connection of the adapter and flexible check valve. The specific elements and attachment method will be further described below in association with FIGS. 7-11. While shown in cross-section, all described features are retained around the entire circumference.

As shown, flexible check valve 700 retains similar valve construction and functionality of the valves previously described and illustrated in FIGS. 4*a* through 5*e* and can retain various flap configurations, slits, and lobe structures without departing from the scope of the present invention. However, in this preferred embodiment, the flexible check valve enclosure tube 702 has been modified to enable a functional interconnection with preferred embodiment adapter 704. Enclosure tube 702 is ergonomically tapered towards the distal drinking end and flared 703 towards the connection end to functionally accommodate inner protruding bayonet members 708 and snap-fit ring 714. The flexible check valve components are preferably made from silicone although other functionally equivalent safe and flexible materials may be substituted without departing from the scope of the present invention. Bayonet members 708 extend internally to engage, in a mating relationship, boss surfaces 710 and 712 of adapter 704 and include angled surface 716. Snap-fit ring 714 compressively retains the bayonet-adapter mating engagement in a locked position and, in one embodiment, includes an optional internal lip 715 which assists in preventing upward movement when fully seated. Snap-fit ring 714 should be made of relatively rigid materials (e.g. rigid polypropylene, PVC, etc.).

Figure 8:
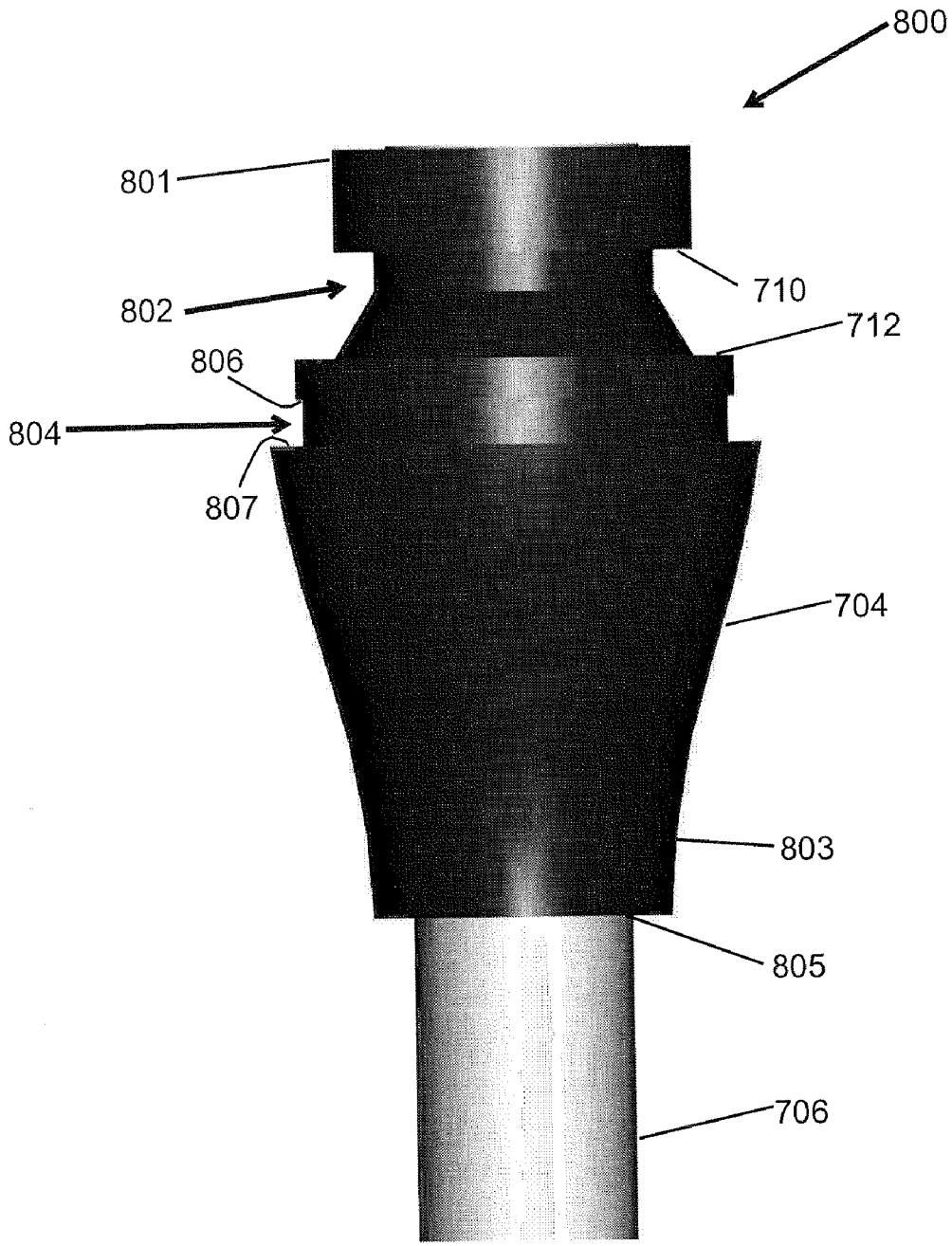
FIG. 8 illustrates a preferred embodiment adapter connected to a fluid tube (e.g. straw).

FIG. 8 illustrates a side view 800 of a preferred embodiment adapter and straw. In general, the adapter 704 may be attached to known straws 706 (e.g. straws previously illustrated in FIGS. 1 and 2) using any known method such as: over molding, mechanical attachment, sonic welding, shrink tube (heat shrink), friction fit, or adhesives. The straw is fed through a central opening in the adapter and runs the entire length of the adapter. The adaptor is preferably made of a similar material to the straw (e.g. both formed of a plastic such as polypropylene) to enable easy "material matched" connecting techniques (e.g. adhesives, sonic welding).

As shown in FIG. 8 (from top-down), adaptor 704 comprises: head section 801, boss 710, bayonet receiving section 802 (recess), boss 712, snap-fit ring vertical movement locking section 804, boss 806, seat 807, tapered section 803 and bottom 805.

Figure 9:
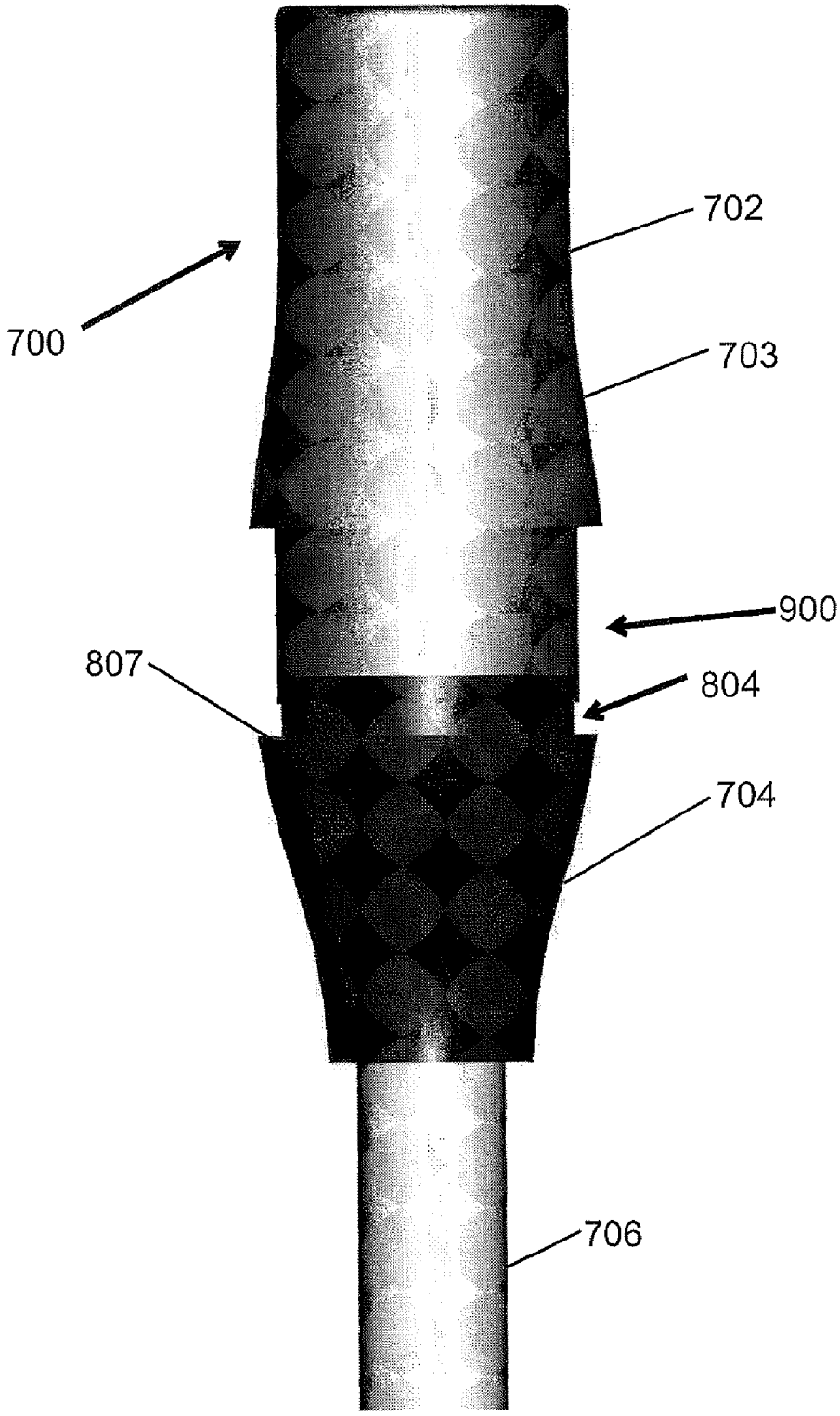
FIG. 9 illustrates a preferred embodiment flexible check valve connected to the adapter shown in FIG. 8.

FIG. 9 illustrates a preferred embodiment flexible check valve connected to the adapter 704 of FIG. 8. During assembly, the adapter 704 is first permanently attached to straw 706 (using previously cited bonding methods or equivalents) and the flexible check valve enclosure tube 702 is pressed onto the adapter until bayonet section 708 fits into bayonet receiving section 802 (see fully seated position in FIG. 7). During pressing, the bayonet section 708 will flexibly expand outward under force due to a physical interaction of bayonet angled surface 716 and head 801 and snap back into original shape within the bayonet receiving section 802 after clearing boss 710. Once fully mated, a snap-fit ring receiving recess 900 remains. The snap-fit ring recess 900, in one embodiment, includes the previously discussed snap-fit ring vertical movement locking section 804.

Figure 10:
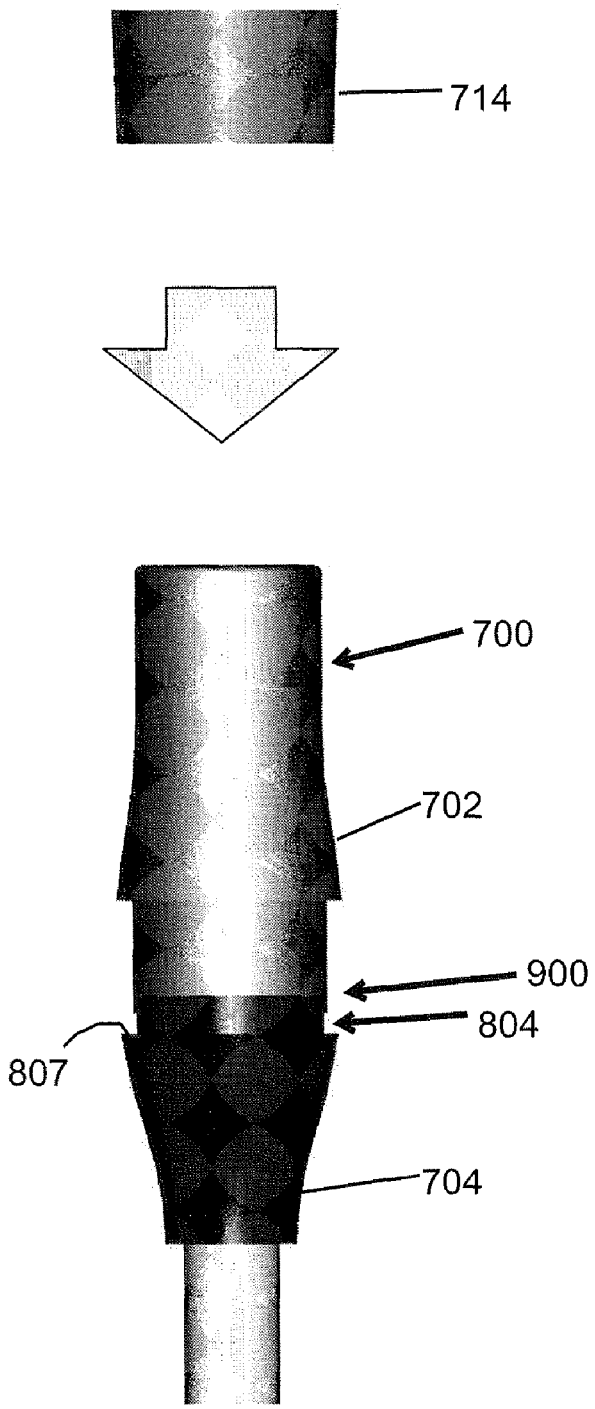
FIG. 10 illustrates a preferred embodiment snap-fit ring before final assemblage with FIG. 9 flexible check valve and adapter.
Figure 11:
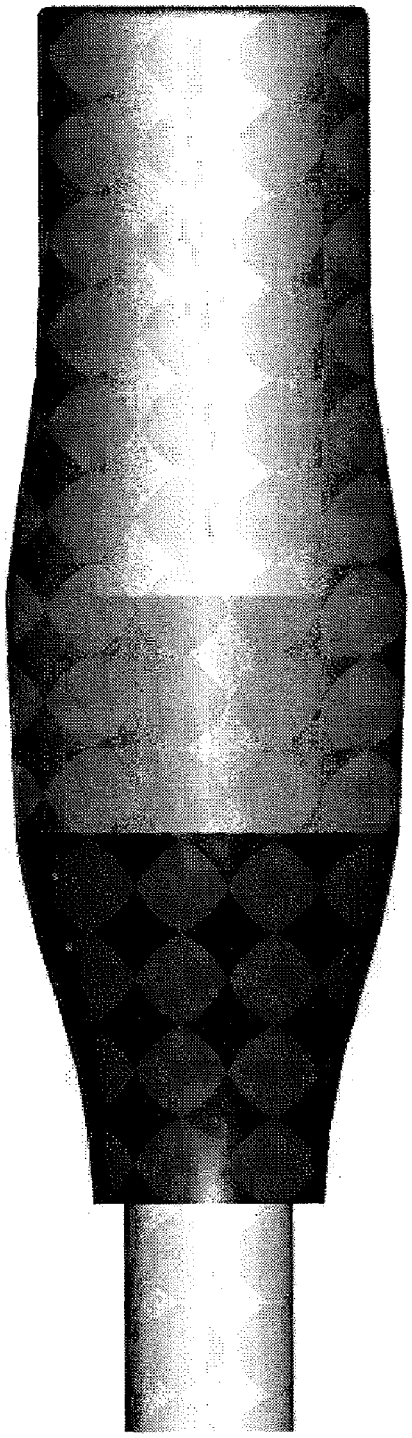
FIG. 11 illustrates a preferred embodiment snap-fit ring after final assemblage with FIG. 9 flexible check valve and adapter.

FIG. 10 illustrates a preferred embodiment snap-fit ring before final assemblage with FIG. 9 flexible check valve and adapter. Snap-fit ring 714 is slid over flexible check valve enclosure tube 702 compressing the flared middle section 703. Once the snap-fit ring clears the flared section, the flared section expands back to its original shape thus preventing the ring from being upwardly removed. Seat 807 prevents downward removal. In a preferred embodiment, snap-fit ring 714 includes an inner lip 715 at a bottom edge which mates with snap-fit ring vertical movement locking section 804. This inner lip restricts upward movement of the snap-fit ring while in the assembled state.

FIG. 111 illustrates preferred embodiment snap-fit ring 714 after final assemblage with FIG. 10 flexible check valve and adapter. All joint connections should be tight and smooth. FIG. 111 represents the external view of FIG. 7.

The present invention uniquely enables the interconnection of dissimilar materials (silicone and polypropylene) in a tubular fluid path environment. The steps for connecting a flexible check valve of a first material to a tubular fluid path of a second material are as follows:

a) permanently fixing, at a tapered proximal end, an adapter made of a second material to said tubular fluid path, said adapter comprising at least: a flexible check valve receiving end and recessed section;
b) pressing a flexible check valve onto said flexible check valve receiving end, said flexible check valve comprising an inwardly protruding section;
c) said pressing step continuing until said inwardly protruding sections are mated within said recessed section, said mating leaving an external snap-fit ring receiving section;
d) sliding a snap-fit ring over said flexible check valve, said sliding step circumferentially compressing said flexible check valve;
e) and wherein said sliding step is performed until said snap-ring is fully seated within said snap-ring receiving section.

Once the snap-fit ring has been installed, an area of interference exists between the internal surface of the ring and the outer section (head 801) of the adapter. Various embodiments may include adapters that create 5 thousandths and 10 thousandths interference. The more aggressive 10 thousands interference, in some embodiments, is most beneficial in retaining the valve to the adapter. The less interference, the easier it will be to load the snap-fit ring during automation. The interference actually squeezes the elastomeric silicone flexible check valve which assists with the problem of the valve thinning when pulled. The area of the valve above the larger mass is 30 thousandths thick. Once you pull on the valve, this area is thinned (e.g. to 15 thousands) very quickly. The interference helps fight this wall thinning that ultimately leads to the mass beginning to thin and extruding out of the entrapment area. The mass will actually begin to rotate and then extrude out. In one embodiment, an additional 10 thousandths is added below the flexible check valve mass area to assist in assembly, i.e. provides relief while the snap-fit ring is being installed. The ring has built-in interference; therefore when loading the snap-fit ring, the flexible check valve wants to creep down for a moment. Once the snap-fit ring is fully loaded, a 10 lb pull is applied to the end of the flexible check valve to correctly seat the flexible check valve and test the assembly.

CONCLUSION

A system and method has been shown in the above embodiments for the effective implementation of a snap-fit valve. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by size, materials, or specific manufacturing techniques.

In addition, the flexible check valve structure, manufacturing and attachment techniques can be used to prevent pressurized loss/retention of any liquid, gas, powder, particulate, gel, or colloid. The apparatus can be equally applied to non-juice container straws (e.g. other straws, baby bottle nipples, etc.) and be used in alternative fields such as medical. The completeness of leakage prevention may be based on the quality of materials, manufacturing techniques, attachment techniques, and pressures encountered. In any embodiment, the configuration should substantially prevent fluids from escaping past the flexible check valve and ideally provide a 100% check.

What is claimed is:

1. A flexible check valve retention system, the system comprising:

a. a tube providing a fluid path;

b. an adapter comprising polypropylene and having a proximal and distal end, the proximal end fluid sealably connected to the tubular section;

c. a flexible check valve comprising silicone, connected to and disposed over a portion of the distal end of the adapter and operatively connected to the fluid path, the flexible check valve and the adapter in combination defining a receiving recess, wherein the check valve opens to permit fluid flow through the fluid path upon exposure to a circumferentially compressive force and prevents fluid flow through the adapter from the tube while the flexible check valve is in a normally closed position; and d. a snap-fit ring retaining the operative interconnection of the adapter and the flexible check valve, the snap-fit ring being disposed within the receiving recess and secured therein by the flexible check valve and the adapter, and wherein the snap-fit ring prevents separation of the adapter and the flexible check valve and maintains fluid sealable engagement between the adapter and the flexible check valve.

2. A flexible check valve retention system, as per claim 1, wherein the fluid is any of: a liquid, a gas, a gel, a colloid, a powder, and a particulate.

3. A flexible check valve retention system, as per claim 1, wherein the adapter is connected to the tubular section using bonding techniques.

4. A flexible check valve retention system, as per claim 3, further comprising a drinking container operatively connected to the tube, wherein the tube is straw for removal of liquid from the drinking container.

5. A flexible check valve retention system, as per claim 4, wherein the drinking container comprises a juice box.

6. A flexible check valve retention system, as per claim 4, wherein the drinking container comprises a juice pouch.

7. A flexible check valve retention system, the system comprising:

a. a tube providing a fluid path;

b. an adapter comprising polypropylene and having a proximal and distal end, the proximal end fluid sealably connected to the tubular section;

c. a flexible check valve comprising silicone, connected to and disposed over a portion of the distal end of the adapter and operatively connected to the fluid path, the flexible check valve and the adapter in combination defining a receiving recess, wherein the check valve opens to permit fluid flow through the fluid path upon exposure to a circumferentially compressive force and prevents fluid flow through the adapter from the tube while the flexible check valve is in a normally closed position; and d. a snap-fit ring retaining the operative interconnection of the adapter and the flexible check valve, the snap-fit ring being disposed within the receiving recess and secured therein by the flexible check valve and the adapter, wherein the snap-fit ring permanently retains the interconnection of the adapter and the flexible check valve and maintains fluid sealable engagement between the adapter and the flexible check valve.

8. A flexible check valve retention system, as per claim 7, further comprising a drinking container operatively connected to the tube, wherein the tube is a straw for removal of liquid from the drinking container.

9. A flexible check valve retention system, as per claim 8, wherein the drinking container comprises a juice box.

10. A flexible check valve retention system, as per claim 8, wherein the drinking container comprises a juice pouch.

11. A flexible check valve retention system, the system comprising:

a. a tubular section providing a fluid path;

b. an adapter comprising polypropylene and having a proximal and distal end, the proximal end connected to the tubular section;

c. a flexible check valve comprising silicone and being operatively connected to the distal end of the adapter and operatively connected to the fluid path, the flexible check valve comprising an inwardly protruding section, the flexible check valve and the adapter in combination defining a receiving recess, wherein the check valve opens to permit fluid flow through the fluid path upon exposure to a circumferentially compressive force;

d. the adapter additionally comprising a recess for mating with the inwardly protruding section of the flexible check valve; and e. a snap-fit ring retaining the mated connection of the inwardly protruding section and the recess, the snap-fit ring being disposed within the receiving recess and secured therein by the flexible check valve and the adapter, wherein the snap-fit ring permanently retains the interconnection of the adapter and the flexible check valve and maintains fluid sealable engagement between the adapter and the flexible check valve.

12. A flexible check valve retention system, as per claim 11, further comprising a drinking container operatively connected to the tubular section, wherein the tubular section is a straw for removal of liquid from the drinking container.

13. A flexible check valve retention system, as per claim 12, wherein the drinking container comprises a juice box.

14. A flexible check valve retention system, as per claim 12, wherein the drinking container comprises a juice pouch.

15. A flexible check valve retention system, as per claim 11, wherein the flexible check valve comprises any of: a duckbill or crossbill configuration.

16. A flexible check valve retention system, as per claim 11, wherein the adapter is connected to the tubular section using bonding techniques.

17. A flexible check valve retention system, as per claim 16, wherein the bonding techniques comprise any of: sonic welding, friction fit, adhesives, collar, and heat shrink methods.

18. A flexible check valve retention system, the system comprising:

a. an adapter comprising polypropylene and having at least a distal section, a recessed section with upper and lower bosses, a lower seat, and a tapered proximal end;

b. a flexible check valve comprising silicone operatively connected to the distal section of the adapter, the flexible check valve comprising an inwardly protruding bayonet section, the flexible check valve and the adapter in combination defining a receiving recess, wherein the check valve opens upon exposure to a circumferentially compressive force;

c. the adapter and flexible check valve operatively interconnected by a mating of the inwardly protruding bayonet section and the recessed section, the inwardly protruding bayonet section vertically retained by the upper and lower bosses; and d. a snap-fit ring circumferentially retaining the mated connection of the inwardly protruding bayonet section and the recessed section, the snap-fit ring being disposed within the receiving recess and secured therein by the flexible check valve and the adapter, wherein the snap-fit ring permanently retains the interconnection of the adapter and the flexible check valve and maintains fluid sealable engagement between the adapter and the flexible check valve.

19. A flexible check valve retention system, as per claim 18, further comprising a drinking container operatively connected to the adapter to prevent unwanted leakage therefrom.

20. A method for connecting a tubular fluid path to a flexible check valve comprising silicone, the method comprising:

a. permanently fixing, at a tapered proximal end, an adapter made of polypropylene to the tubular fluid path, the adapter comprising at least: a flexible check valve receiving end and recessed section;

b. pressing a flexible check valve onto the flexible check valve receiving end, the flexible check valve comprising an inwardly protruding section and being capable of opening to permit fluid flow through the fluid path upon exposure to a circumferentially compressive force;

c. continuing the pressing step until the inwardly protruding section is mated within the recessed section, the mating leaving an external snap-fit ring receiving section; and d. sliding a snap-fit ring over the flexible check valve, the sliding step circumferentially compressing the flexible check valve, wherein the sliding step is performed until the snap-ring is fully seated within the snap-ring receiving section, and wherein the snap-fit ring maintains a fluid sealable engagement between the adapter and flexible check valve.

21. A method for connecting a tubular fluid path to a flexible check valve comprising silicone as per claim 20, further comprising a drinking container operatively connected to the tubular section, wherein the tubular fluid path is a straw for removal of liquid from the drinking container.

22. A method for connecting a tubular fluid path to a flexible check valve comprising silicone, as per claim 21, wherein the drinking container comprises a juice box.

23. A method for connecting a tubular fluid path to a flexible check valve comprising silicone, as per claim 21, wherein said the drinking container comprises a juice pouch.

* * * * *